United States Patent [19]

Vogtmann et al.

[11] 4,119,256

[45] Oct. 10, 1978

[54] STRIP PINCH ROLL APPARATUS

[75] Inventors: Lothar Vogtmann, Hilchenbach; Martin Braun; Josef Kregl, both of Kreuztal, all of Fed. Rep. of Germany

[73] Assignee: Schloemann-Siemag Aktiengesellschaft, Fed. Rep. of Germany

[21] Appl. No.: 778,206

[22] Filed: Mar. 16, 1977

[30] Foreign Application Priority Data

Apr. 2, 1976 [DE] Fed. Rep. of Germany ..... 2614254

[51] Int. Cl.[2] ..... B65H 17/20

[52] U.S. Cl. ..... 226/177; 226/180; 226/187; 226/194

[58] Field of Search ..... 226/177, 176, 186, 180, 226/181, 185, 187, 194, 1; 271/273, 274

[56] References Cited

U.S. PATENT DOCUMENTS

| | | | |
|---|---|---|---|
| 1,867,343 | 7/1932 | Wittek | 226/176 X |
| 2,796,781 | 6/1957 | Mills | 226/176 X |
| 3,227,345 | 1/1966 | Eckhardt | 226/176 |
| 3,647,127 | 3/1972 | Wiig | 226/177 X |
| 3,661,310 | 5/1972 | Gross | 226/177 X |
| 4,029,251 | 6/1977 | Johnson | 226/176 X |

*Primary Examiner*—Bruce H. Stoner, Jr.
*Attorney, Agent, or Firm*—Daniel Patch; Suzanne Kikel

[57] ABSTRACT

This disclosure relates to a pinch roll unit for feeding hot rolled strip to a down coiler employed in a hot strip mill. The upper roll of the pinch roll unit is mounted on a beam which is adjustable by a jack screw against the pressure of a piston cylinder assembly to set the gap between the pinch rolls. The upper roll of the pinch roll unit in addition is further loaded by a double-acting regulatable auxiliary piston cylinder assembly carried by the beam for controlling the gap pressure between the pinch rolls and hence the tension on the strip.

13 Claims, 8 Drawing Figures

STRIP PINCH ROLL APPARATUS

The present invention relates to a method for regulation of strip tension contact pressure on driving equipment for strip, especially before strip down coiler in wide hot strip mill, in which two rolls are set to a gap spacing corresponding to the strip thickness and are loaded at a predetermined constant holding force in direction against each other. The invention further relates to driving or feeding apparatus for rolled strip, especially for arrangement before strip down coiler in wide strip mill, such apparatus comprising for example two driving or feeding rolls, which for presetting to different strip material thicknesses are bringable to a spacing relative to one another by lifting screw gears and which for setting of the roll contact pressure are set through pressure means cylinders under holding force in direction against each other, one of the rolls being journalled in a beam, which on the one hand is supported on the lifting screw gears and at which on the other hand the pressure means cylinders engage.

It has been established that, for a good guidance of strip fed into a strip down coiler in a wide hot strip mill, it is important to keep the roll contact pressure in the apparatus down to a level at which frictional driving of the strip by the rolls, taking as basis a co-efficient of friction = 0.25 and a safety factor of 2, is maintained.

For the fulfilment of this requirement, it is, however, necessary to regulate the roll contact pressure in dependence upon the strip thickness and strip width, so that the specific strip tension reduces with increasing strip thickness.

In the case of the afore-described known driving apparatus, a sufficiently sensitive regulation of the roll contact pressure, and thereby of the specific strip tension, is either not achieved or is not achieved satisfactorily because a correspondingly sensitive setting of the roll contact pressure is not possible by the known arrangement of the pressure means cylinders. Moreover, eccentric loadings of the apparatus by the strip cannot be compensated for, since bracings arise due to the inherent stiffness of the beam.

According to a first aspect of the present invention, there is provided a method of regulating roll contact pressure on metal strip material fed by a roll pair, comprising the steps of setting the rolls of the roll pair at a spacing corresponding to the thickness of strip material to be fed by the roll pair, loading the rolls in direction towards each other with a predetermined constant holding force, and further loading one of the rolls with a regulateable auxiliary force selectably in the same direction as or opposite direction to the effective direction of the holding force loading that roll.

Thus, a regulateable auxiliary force is associated with the constant holding force, which seeks to maintain between the rolls the spacing set to the respective strip material thickness, and is made effective either in or against the effective direction of the holding force.

By this method, at least three different modes of operation of feeding apparatus incorporating the roll pair can be set without need for change of the holding force.

Thus, for strips with a width up to 1000 millimeters and a thickness of 1.5 to 20 millimeters, there can be set a roll contact force which corresponds to the inherent weight of the upper driving roll and an associated bearing less a relieving force, which is generated through the auxiliary force and which is directed against the driving roll and the bearing thereof.

For strips over 1000 millimeters in width with thicknesses of 1.5 to 20 millimeters, but with the exception of strips from 2080 millimeters in width and from 14 millimeters in thickness, the roll contact pressure can, by contrast, be so regulated that it is derived from the inherent weight of the upper driving roll and the bearing thereof plus an additional force generated through the auxiliary force.

Finally, for strips from 2080 millimeters in width and from 14 millimeters in thickness, there may be generated a roll contact pressure which corresponds to the inherent weight of the upper driving roll, bearing and support beam plus an additional force resulting from the constant holding force.

Expediently, the holding force, on the auxiliary force being directed thereagainst, is transmitted indirectly by way of the auxiliary force to said one roll.

So that eccentric loading of the rolls by the strip can be compensated for, the auxiliary force is preferably associated with the holding force at each of two bearing locations for said one roll.

According to a second aspect of the present invention there is provided apparatus for use in a hot strip mill and comprising a roll pair to feed metal strip material, one of the rolls of the roll pair being mounted on a pivotal beam by two bearing means which are displaceable independently of each other parallel to the plane of pivotal movement of the beam, setting means supporting the beam and operable to preset the rolls to a selectable spacing, first force applying means acting on the beam and operable to load the rolls in direction towards each other with a predeterminable constant holding force, and second force applying means acting on the bearing means and operable to load said one roll with a regulateable auxiliary force selectably in the same direction as or opposite direction to the direction of the holding force applied to that roll by the first force applying means.

Preferably, the two bearing means are guided to be limitedly displaceable in windows or pockets at the beam. Alternatively, the two bearing means are carried by levers articulated at the beam. In this case, it is expedient to arrange the two levers on a common bearing axle at the beam. This bearing axle can be constructed as a torsion bar, which, due to its inherent resilience, can provide a degree of interdependence of movement between the two levers or can effect a degree of torsional stiffness of each lever relative to the beam.

Expediently, the second force applying means comprises a double-acting fluid as for example pneumatic piston-cylinder means engaging at each of the two bearing means. The two fluid piston-cylinder units can be arranged on the beam.

Preferably, the respectively loaded piston surfaces of the two pneumatic piston-cylinder units are connectable in parallel to a common air tank, the pressure level of which is steplessly regulateable or settable, preferably between 0 and 10 bars.

It may be further provided that the piston surfaces of the pneumatic piston-cylinder units acting against piston-cylinder units constituting the first force applying means can be loaded at the same pressure level as the latter units. For preference, a parallel attitude of the roll mounted on the beam to the other roll is determined in the basic setting by incorporation in the beam of adjusting plates.

An embodiment of the present invention will now be more particularly described by way of example with reference to the accompanying drawings, in which.

Figure 2:
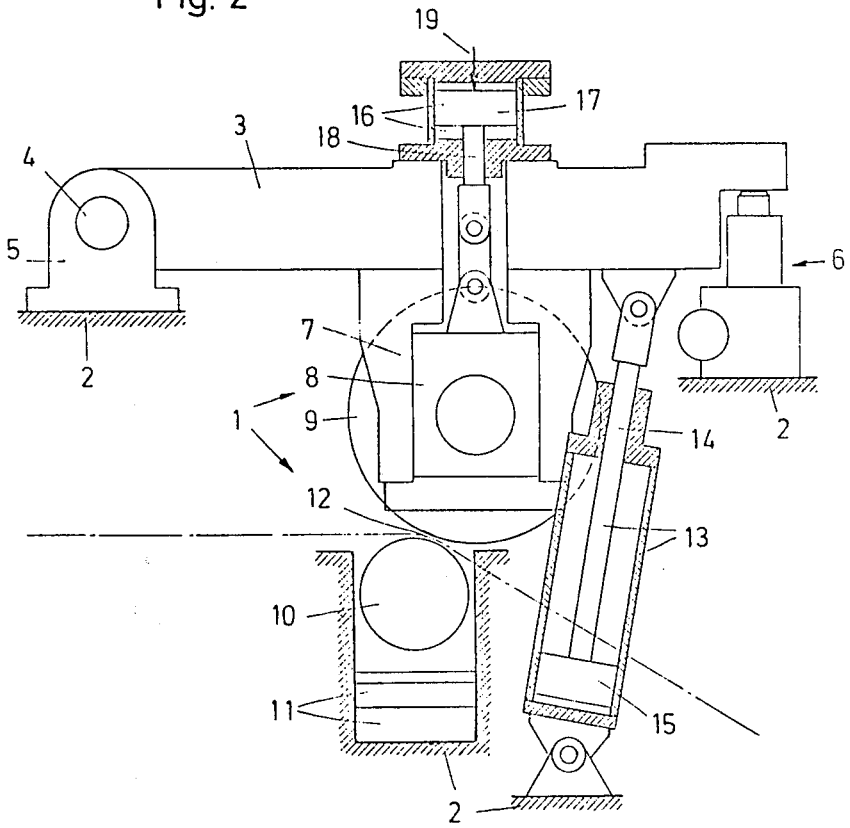
FIG. 2 is a schematic partly sectioned elevation of apparatus embodying the invention, in its operational setting for strips of from 1.5 to 14 millimeters in thickness and up to 2080 millimeters in width, before the entry of the strip into the apparatus.
Figure 2A:
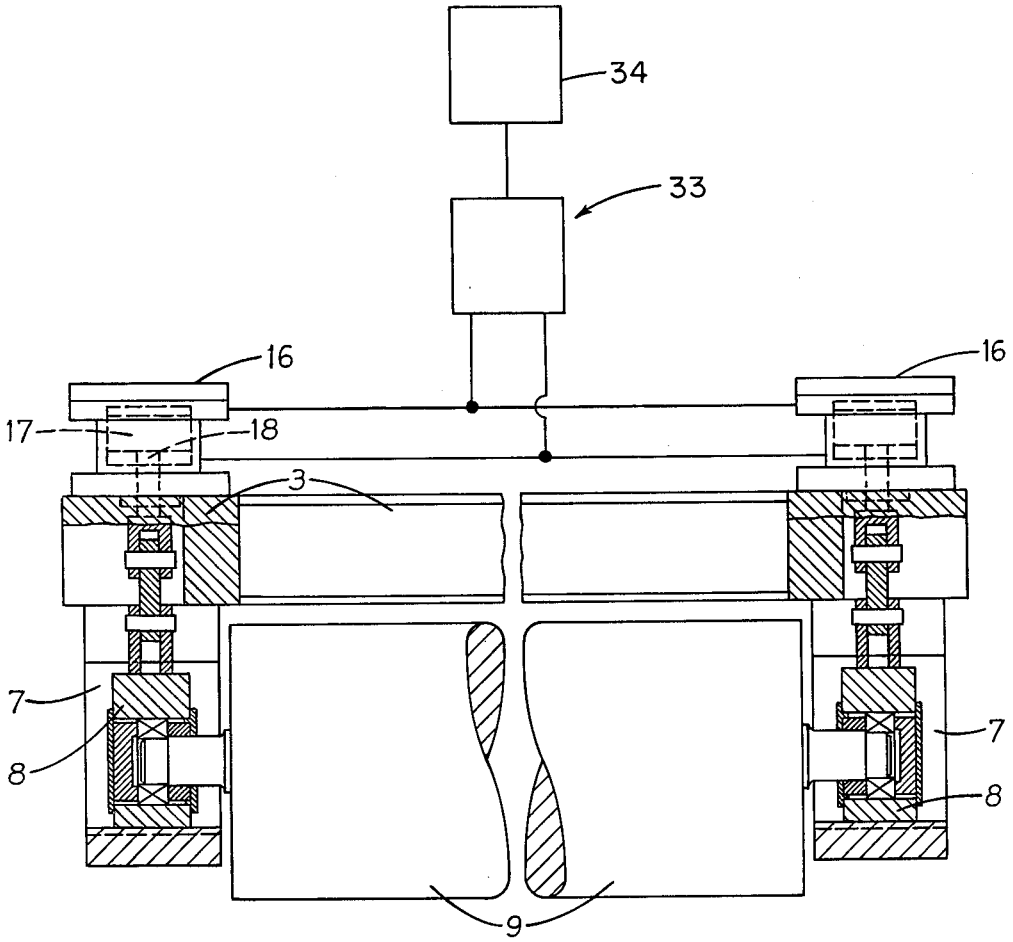

FIG. 2*a* is a sectional view taken along lines 2*a*—2*a* of FIG. 2.

Figure 3:
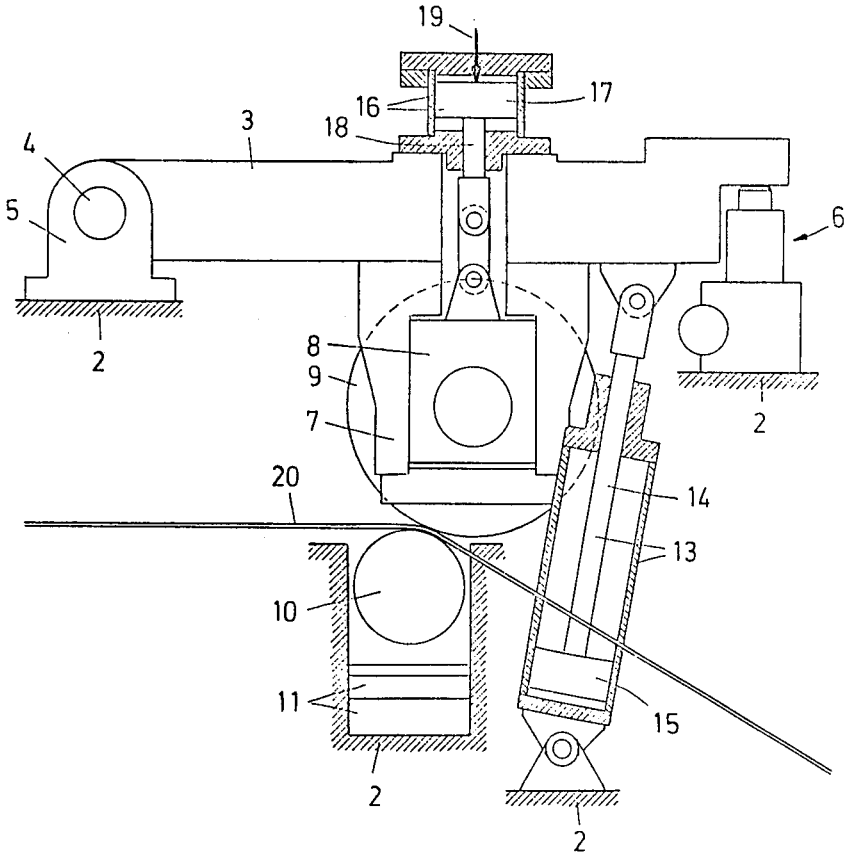
Figure 4:
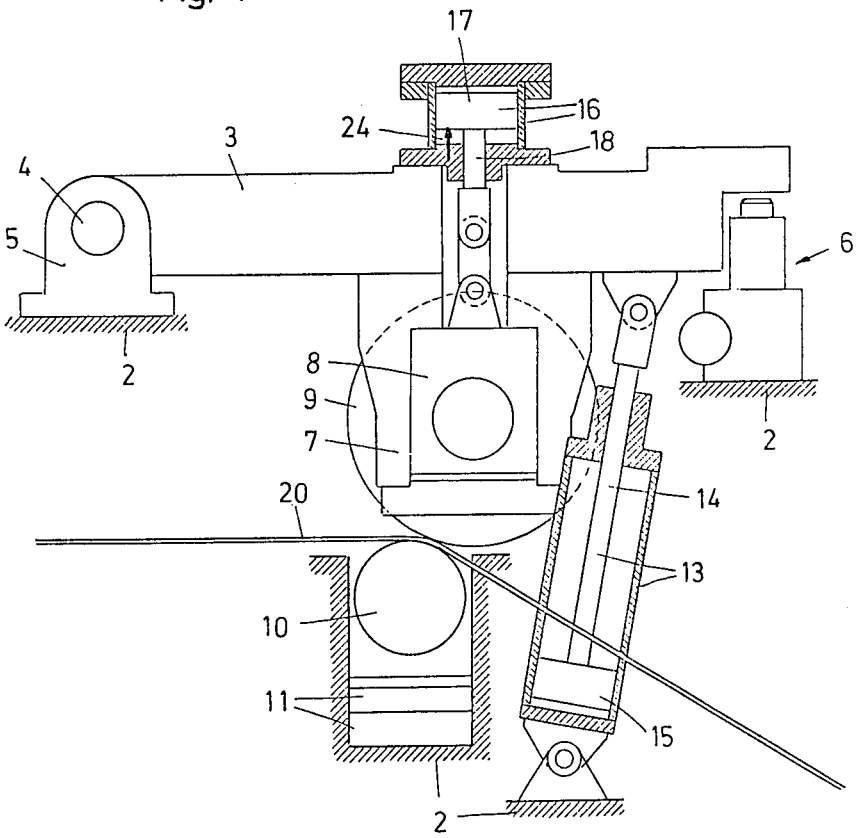
Figure 5:
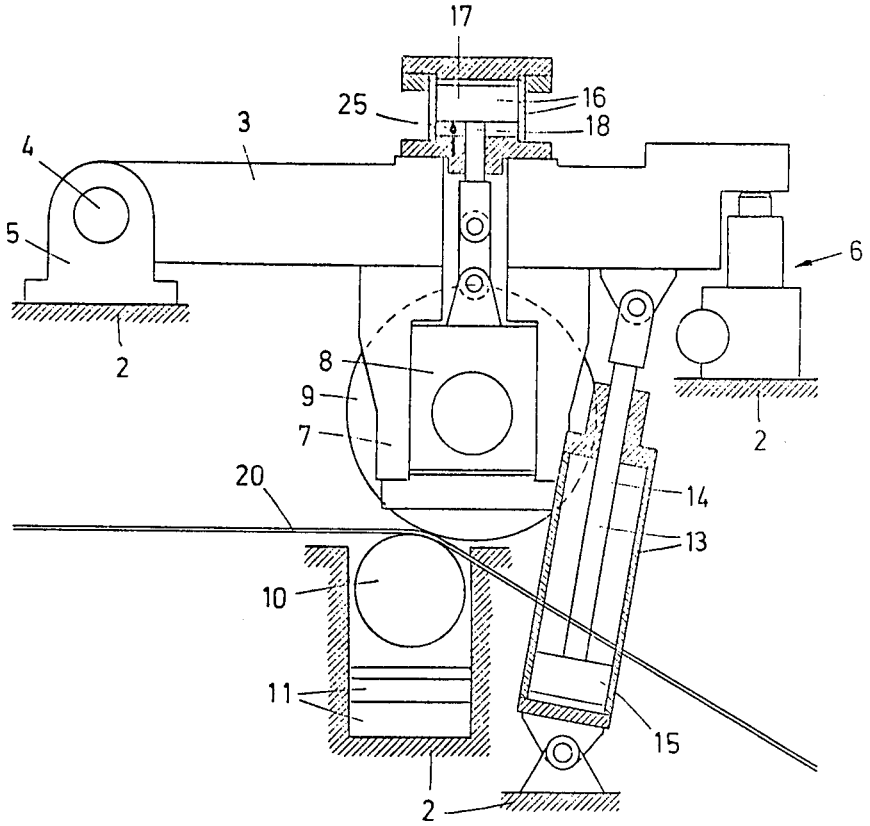
Figure 6:
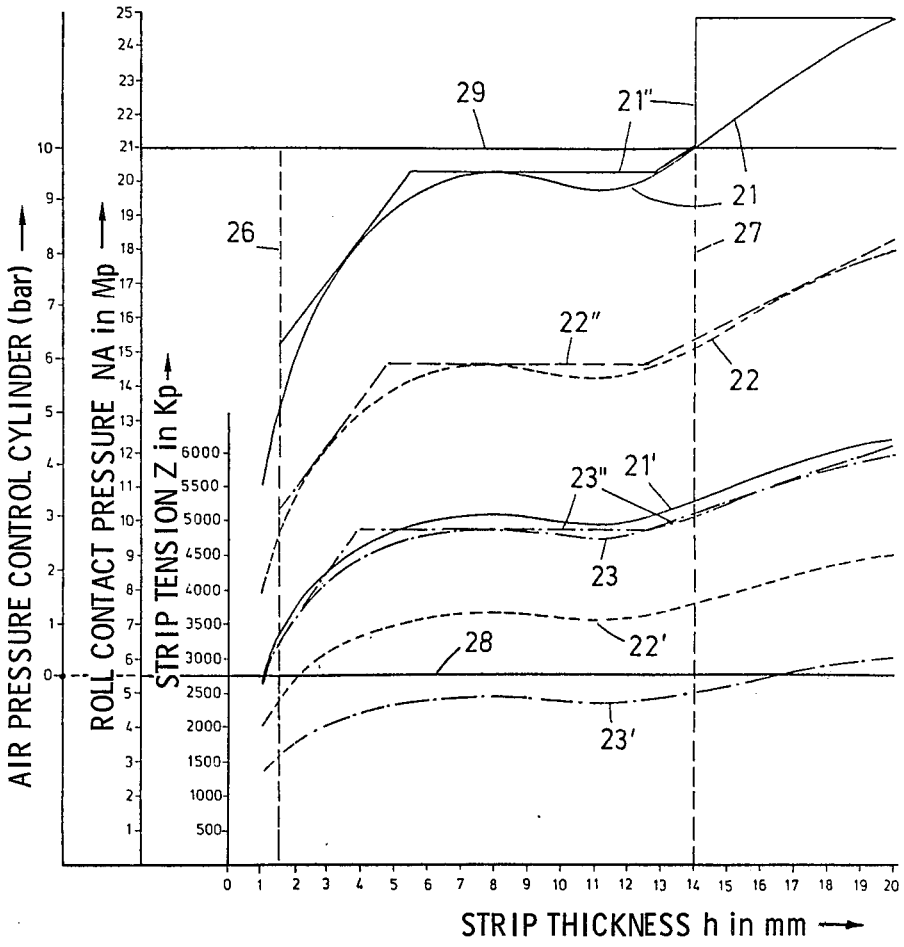

FIG. 3 is a view similar to FIG. 2, showing passage of the strip through the apparatus;

FIG. 4 is a view similar to FIG. 2, but showing the apparatus in its operational setting for rolled strips between 14 and 20 millimeters in thickness and 2080 millimeters in width, and during passage of the strip through the apparatus;

FIG. 5 is a view similar to FIG. 2, but showing the apparatus in its operational setting for rolled strips of from 1.5 to 20 millimeters in thickness and a width of up to 1000 millimeters, and during passage of the strip through the apparatus; and FIG. 6 is a diagram showing roll contact pressures in dependence upon thickness and width of the strip for the three different operational states represented in FIGS. 2 to 5 and FIG. 7 is a schematic elevational view of a second embodiment of the present invention.

Figure 1:
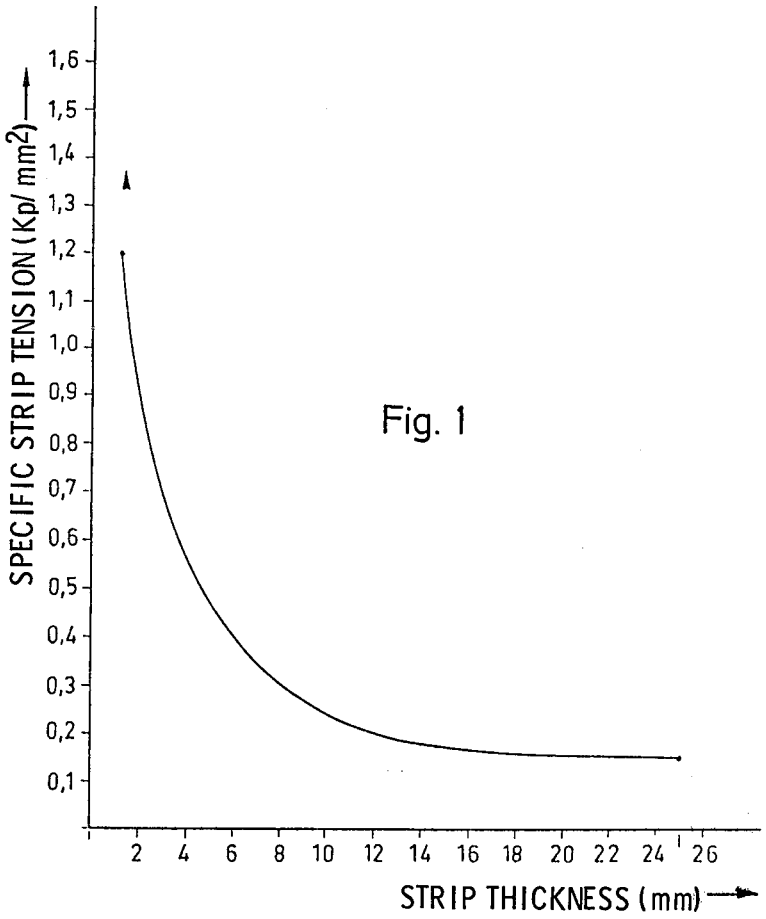
FIG. 1 is a diagram showing desired specific strip tension at different strip thicknesses.

Referring now to the drawings, in FIG. 1, the specific strip tension in kiloponds per square millimeter is plotted on the ordinate of this diagram, while the strip thickness in millimeters is recorded on the abscissa. It is determined by the associated curve which specific strip tension for an optimum operation of the apparatus is appropriate for different thicknesses of strip fed by the apparatus. It is apparent that the specific strip tension drops relatively steeply from 1.2 kiloponds per square millimeter to about 0.35 kiloponds per square millimeter over the strip thickness range of 1.5 to 6.5 millimeters, but drops relatively slowly from 0.35 kiloponds per square millimeter to about 0.15 kiloponds per square millimeter in the strip thickness range of 6.5 to 20 millimeters.

So that the operating conditions indicated in the diagram of the FIG. 1 can be achieved by strip feeding apparatus before a strip down coiler in a wide strip mill, the apparatus is constructed and operated corresponding to the FIGS. 2 to 5.

In FIGS. 2 to 5, there is shown feeding apparatus 1 feeding a strip to a strip downcoiler 36. This feeding apparatus 1 is incorporated in the frame or stand 2 of a wide strip down coiler, the apparatus comprising a beam 3, which at one end is pivotably mounted by a horizontal axle 4 in bearing blocks 5 on the stand 2 and which at its other end is supported on lifting screw gears 6 also arranged on the stand 2.

The beam 3 is provided with two pockets 7, in each of which a bearing housing 8 is displaceable to a limited extent parallel to the plane of the pivotal movement of the beam 3. An upper driving roll 9 is rotatably retained between two bearing housings 8, and a lower driving roll 10 is guided and journalled by compensating devices 11 directly in the stand 2.

The beam 3 can be pivoted in a vertical plane by the lifting screw gears 6 in such a manner that a gap 12 between the rolls 9 and 10 can be matched to the thickness of rolled strip to be fed through the apparatus. Since the beam 3 rests only loosely on the lifting screw gears 6, a pressure medium piston-cylinder unit 13 journalled in the stand 2 of the strip down coiler engages the beam by a piston rod 14, a piston 15 of the unit being so loadable, for example by compressed air, that it tends to hold the beam 3 by a constant holding force in touching contact with the lifting screw gears 6.

Particularly referring to FIG. 2*a*, mounted on the beam 3 above each of the two bearing housings 8 is a respective pressure medium piston-cylinder unit 16, which comprises a piston 17 connected by a piston rod 18 with the bearing housing 8 disposed thereunder. The beam is provided with adjusting plates arranged to set the roll 9 in a parallel attitude relative to the other roll 10.

The two piston-cylinder units 16 are constructed as double-acting pneumatic piston cylinder units, i.e. the piston 17 of each unit can selectively be loaded from above or below with compressed air. As best shown in FIG. 2*a* piston cylinder units 16 are connected in parallel on corresponding sides of the pistons of the units to a common source in the form of a compressed air tank 33. Regulating means 34 is provided to steplessly regulate the pressure of the compressed air to effect different movements of the piston 17 and hence independent displacement of the two bearings 8. According to the effective direction of the compressed air in the units 16, the bearing housings 8 for the upper roll 9 are pushed either downwardly or upwardly in the pockets 7 of the beam 3.

It is essential for the manner of operation of the apparatus illustrated in FIG. 2, that the piston-cylinder unit 13 exerting the holding force on the beam 3 is loaded with a permanent constant air pressure of, for example, 10 bars, which always counteracts the supporting direction of the lifting screw gears 6, and that the compressed air loading the pneumatic piston-cylinder units 16 can be steplessly regulated in its pressure level, for example, between 0 and 10 bars, both units 16 being disposed in communication with the same pressure tank 33. The tank volume is so dimensioned relative to the volume of the two units 16 that no, or only insubstantial, force changes arise from different movements of the pistons 17 of the units 16.

Different movements of the pistons 17 are possible because the two bearing housings 8 for the roll 9 are guided to be movable independently of one another in the pockets 7 of the beam 3, so that, on eccentric loading of the roll 9 by the strip, they can correspondingly displace individually.

Different modes of operation of the apparatus will now be described in detail.

In a first mode of operation, the rolled strips to be driven by the apparatus into a strip down coiler have a width of more than 1000 millimetres but less than 2080 millimetres and a thickness of 1.5 to 20 millimetres. For this mode of operation, the apparatus is provided, before the entry of the strip, with the setting shown in FIG. 2, i.e. the beam 3 is supported on the lifting screw gears 6 in the position set to the thickness of the strip so as to appropriately set the gap 12 between the rolls 9 and 10, and in this position is loaded in downward direction by the piston-cylinder unit 13 loaded with constant air pressure. At the same time, the pistons 17 of the two pneumatic piston-cylinder units 16 are loaded in the direction of arrow 19 (FIG. 2) at their upper piston surface with an air pressure of 0 to 10 bars, so that the two bearing housings 8 are moved into their lower end positions in the pockets 7. As shown in FIG. 3, as soon as the strip 20 runs into the gap 12 between the two rolls 9 and 10, the upper roll 9 is slightly raised so that the two bearing housings 8 correspondingly move upwardly with it in the pockets 7, i.e. against the air pressure 19 in the pneumatic piston-cylinder units 16. As a result, a roll contact pressure, which is equal to the inherent weight of the roll 9 and the bearing housings 8 plus an auxiliary force generated by the air pressure 19, acts on the strip 20.

If it is assumed that, for example, the width of the strip of 1500 millimetres, then the curve 22 in FIG. 6 indicates how large the roll contact pressure should be for the different strip thicknesses, so that a strip tension Z in kiloponds, indicated by the line 22' in FIG. 6, is attained. Line 22" in FIG. 6 indicates which pressure level the air pressure 19 in the pneumatic piston-cylinder units 16 must have each time.

In a second mode of operation shown in FIG. 4, the apparatus is set to feed strips with a width of 2080 millimetres and a thickness of 14 to 20 millimetres to the strip down coiler. In this case, the unit 13 is loaded, as in the case of the mode of operation according to FIGS. 2 and 3, by compressed air which has a constant pressure level of, for example, 10 bars. However, the pistons 17 of the two hydraulic units 16 are loaded with a correspondingly high, constant pressure level of, for example, 10 bars, in the direction of arrow 24, i.e. against the lower piston surface. As a result, the two bearing housings 8 are drawn into the pockets 7 and against their upper abutments.

The contact pressure of the roll 9 against the strip 20 in that case derives from the inherent weights of the roll 9, its bearing housings 8, and the beam 3, plus the holding force exerted by the unit 13 on the beam 3, because the beam 3 on entry of the strip 20 into the gap 12 is raised from the lifting screw gears 6.

If the given width of the strip 20 of 2080 millimetres is taken as the basis, then in FIG. 6 the curve 21 indicates how great the roll contact pressure NA in megaponds must be when the strip tension represented by the curve 21' is to be generated by the apparatus. The stepped line 21" indicates how great the total weight of the beam 3, roll 9 and bearing housings 8 must be in order to obtain, in conjunction with the holding force supplied by the unit 13, optimum roll contact pressure NA for this mode of operation.

Finally, in FIG. 5 there is shown a third mode of operation for the feeding of strips having a width of up to 1000 millimetres and a thickness of 1.5 to 20 millimetres. The unit 13 also operates in this case with a constant holding force of, for example, 10 bars. On the other hand, the units 16 are loaded by a regulated air pressure of 0 to 10 bars, in the direction of arrow 25, i.e. against the undersides of the pistons 17. This results in a roll contact pressure which is smaller than the inherent weight of the roll 9 and the bearing housings 8, namely smaller by a value which is determined by the set pressure level of the compressed air acting in the direction of the arrow 25.

If it is assumed that the strip has a width of 1000 millimetres, then the curve 23 in FIG. 6 indicates the respective roll contact pressure NA in megaponds for the different strip thicknesses. In that case, the strip tension Z in kiloponds coming into effect at the strip is indicated by the curve 23'. The stepped line 23" indicates how high the air pressure level of the auxiliary force 25 must be to maintain the roll contact pressure NA in correspondence with the line 23 and the strip tension Z in correspondence with the line 23'.

The two vertical dashed lines 26 and 27 in FIG. 6 delimit the strip thickness range within which the width of the strip can lie as desired between the minimum of 650 millimetres and the maximum of 2080 millimetres. To the right of the vertical dashed line 27 is the operational range for the apparatus within which the strip thickness can be varied with a maximum width of the rolled strip of 2080 millimetres.

The two horizontal solid lines 28 and 29 in FIG. 6 delimit the range within which the air pressure 19 or 25, respectively, is steplessly regulateable for the attainment of the optimum roll contact pressure NA and the optimum strip tension Z.

Underneath the line 28 in FIG. 6 lies the range within which the lower roll 10 can be balanced out relative to the upper roll 9 by regulated air feed to the compensating device 11. Conversely, above the line 29 in FIG. 6 is the operational range within which the roll 9 is rigidly fixed to the beam and, in addition to the weight of the beam and the driving roll 9 with its bearing housings 8, the piston-cylinder unit 13 is still drawn upon for generation of the roll contact pressure NA and the strip tension Z.

Figure 7:
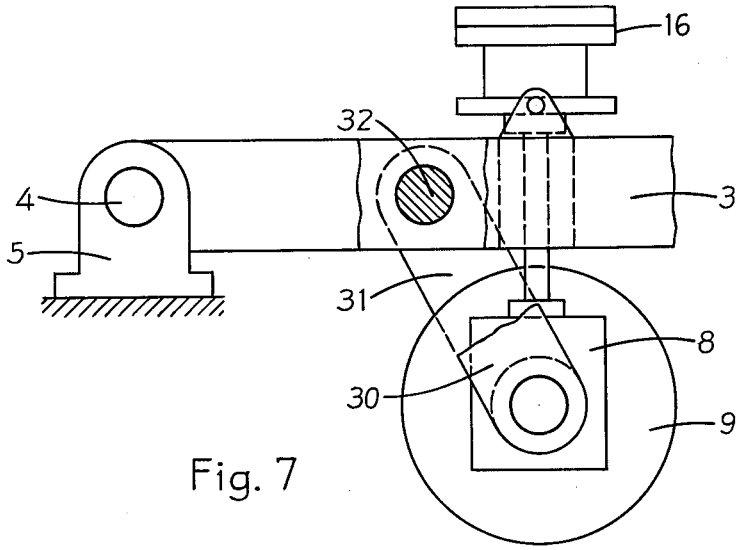

FIG. 7 illustrates a second embodiment of the manner in which the roll 9 is attached to the beam 3.

The roll 9 does not necessarily have to be guided by displaceable bearing housings 8 in two pockets 7 in the beam 3, but it can be carried by levers 30 and 31, which are pivotably mounted on the beam 3 and at which the pneumatic pistonclyinder units 16 engage. It is then expedient to arrange these levers 30 and 31 on a common axle 32 at the beam 3, the axle being able to be constructed as a torsion rod to predetermine the rotational behaviour of the levers relative to one another or relative to the beam.

The method and driving apparatus hereinbefore described enable sensitive adaptation to strip dimensions and allow compensation for eccentric loadings brought about by the rolled strip.

In accordance with the provisions of the patent statutes, we have explained the principle and operation of our invention and have illustrated and described what we consider to represent the best embodiment thereof.

We claim:

1. Apparatus for use in a strip mill and comprising a roll pair to feed metal strip material, one of the rolls of the roll pair being mounted on a pivotal beam by two bearing means which are displaceable independently of each other parallel to the plane of pivotal movement of the beam, setting means supporting the beam and operable to preset the rolls to a selectable spacing, first force applying means acting on the beam and operable to load the rolls in direction towards each other with a predeterminable constant holding force, and second force applying means acting on the bearing means and operable to load said one roll with a regulateable auxiliary force selectably in the same direction as or opposite direction to the direction of the holding force applied to that roll by the first force applying means.

2. Apparatus as claimed in claim 1, wherein the setting means comprises a lifting screw.

3. Apparatus as claimed in claim 1, wherein the first force applying means comprises a piston-cylinder unit operable by a pressure medium.

4. Apparatus as claimed in claim 1, wherein the beam is provided with two recesses and the two bearing means each comprise a bearing block guided in a respective one of the recesses to be displaceable through a limited range.

5. Apparatus as claimed in claim 1, wherein the two bearing means each comprise a bearing block carried by a respective lever pivotally connected to the beam.

6. Apparatus as claimed in claim 5, wherein the levers are mounted on a common axle carried by the beam.

7. Apparatus as claimed in claim 6, wherein the axle is constructed as a torsion bar.

8. Apparatus as claimed in claim 1, wherein the second force applying means comprises two double-acting pneumatic piston-cylinder units each engaging a respective one of the two bearing means.

9. Apparatus as claimed in claim 8, wherein the two pneumatic piston-cylinder units are mounted on the beam.

10. Apparatus as claimed in claim 8, wherein the cylinders of the pneumatic piston-cylinder units are connectable in parallel, on corresponding sides of the pistons of the units, to a common source of compressed air, regulating means being provided to steplessly regulate the pressure of the compressed air.

11. Apparatus as claimed in claim 10, wherein the regulating means is operable to regulate the pressure of the compressed air to between 0 and 10 bars.

12. Apparatus as claimed in claim 8, wherein the first force applying means comprises a holding force piston-cylinder unit loadable at a given pressure level by a pressure medium, the pistons of the two pneumatic piston-cylinder units being loadable, in a direction opposite to the force applied to said one roll by the holding force piston-cylinder unit, at the same pressure level.

13. Apparatus as claimed in claim 1, the apparatus being arranged before a strip down coiler in a wide hot strip mill.

* * * * *